US009339672B2

(12) United States Patent
Williams et al.

(10) Patent No.: US 9,339,672 B2
(45) Date of Patent: May 17, 2016

(54) INITIATOR FOR FIRE SUPPRESSANT CANISTER

(71) Applicants: Brent W. Williams, Fort Worth, TX (US); David C. Procious, Fort Worth, TX (US)

(72) Inventors: Brent W. Williams, Fort Worth, TX (US); David C. Procious, Fort Worth, TX (US)

(73) Assignee: Warren Watts Technology, LLC, Fort Worth, TX (US)

( * ) Notice: Subject to any disclaimer, the term of this patent is extended or adjusted under 35 U.S.C. 154(b) by 627 days.

(21) Appl. No.: 13/712,578

(22) Filed: Dec. 12, 2012

(65) Prior Publication Data

US 2013/0175058 A1 Jul. 11, 2013

Related U.S. Application Data

(60) Provisional application No. 61/584,514, filed on Jan. 9, 2012.

(51) Int. Cl.

| | |
|---|---|
| ***A62C 35/08*** | (2006.01) |
| ***A62C 37/11*** | (2006.01) |
| *A62C 3/00* | (2006.01) |
| *A62C 13/22* | (2006.01) |

(52) U.S. Cl.

CPC ..... *A62C 35/08* (2013.01); *A62C 37/11* (2013.01); *A62C 3/006* (2013.01); *A62C 13/22* (2013.01)

(58) Field of Classification Search

CPC ..... A62C 3/006; A62C 13/22; A62C 37/11; A62C 35/08

USPC ..... 169/28, 46; 239/28, 46; 102/205, 363, 102/367

See application file for complete search history.

(56) References Cited

U.S. PATENT DOCUMENTS

| | | | | |
|---|---|---|---|---|
| 1,489,703 | A * | 4/1924 | Johnson | 169/28 |
| 2,328,491 | A * | 8/1943 | Puchner | 169/28 |
| 2,383,048 | A * | 8/1945 | Eckert, Jr. | 169/28 |
| 2,719,589 | A * | 10/1955 | Mapes | 169/9 |
| 3,833,063 | A | 9/1974 | Williams | |
| 3,874,458 | A * | 4/1975 | Williams | 169/59 |
| 3,883,306 | A | 5/1975 | Widen | |
| 3,884,307 | A * | 5/1975 | Williams | 169/59 |
| 5,518,075 | A | 5/1996 | Williams | |
| 6,527,535 | B1 * | 3/2003 | Han | B30B 15/022 264/3.1 |
| 7,472,758 | B1 * | 1/2009 | Stevens et al. | 169/43 |

* cited by examiner

*Primary Examiner* — Ryan Reis
*Assistant Examiner* — Viet Le
(74) *Attorney, Agent, or Firm* — Bracewell LLP

(57) ABSTRACT

A container holding a fire suppressing powder has a top, a cylindrical sidewall and a bottom with a hole, the bottom having a score line defining a segment. An explosive material housing containing an explosive material is mounted to a head of a mounting member. The mounting member has a lower portion smaller in cross-sectional dimension than the head, depending downward from the head and extending through the hole in the bottom. A retainer is secured around the lower portion of the mounting member below the bottom to secure the mounting member to the bottom. A fuse extends through the hole in the bottom, a passage in the mounting member, and into the explosive material housing. A plate is mounted within the container a selected distance below the top, the plate being movable a short distance toward and away from the top in response to ignition of the explosive material.

12 Claims, 3 Drawing Sheets

INITIATOR FOR FIRE SUPPRESSANT CANISTER

CROSS-REFERENCE TO RELATED APPLICATION

This application claims priority to provisional application Ser. No. 61/584,514, filed Jan. 19, 2012.

FIELD

This disclosure relates in general to a canister containing a fire suppressant powder for mounting above cook stoves.

BACKGROUND

Fire suppression canisters may be employed for suppressing kitchen fires. Prior art fire suppression canisters are typically mounted above a cook stove. The mounting may be by a magnet attaching to a vent hood. The canister includes a container that holds a fire suppressant powder, which is dumped out onto the stove in the event a sufficiently high flame is sensed.

The bottom of the container is scored to create weak lines around segments. An initiator is mounted in the container to initiate the opening of the segments to release the fire suppression powder. The initiator contains an explosive powder and a fuse that extends downward through a hole in the bottom of the container. Flames will ignite the fuse, which in turn detonates the explosive powder. The explosion creates a sudden pressure increase in the container that causes the score lines to shear.

While these canisters work well, an improved mounting system for the explosive powder and fuse would be desirable. Specifically, a mounting system that is faster to assemble would be useful. In addition, at times the fire suppression powder tends to compact and not dispense from the container as well as liked.

SUMMARY

An apparatus for suppressing a fire includes a container having a top, a cylindrical sidewall and a bottom with a hole, the bottom having a score line defining a segment. An explosive material housing is located within the container and contains an explosive material. A mounting member having a head larger in cross-sectional dimension than the hole in the bottom is positioned within the container. The mounting member has a lower portion smaller in cross-sectional dimension than the head. The lower portion depends downward from the head and extends through the hole in the bottom. The explosive material housing is secured to the head of the mounting member. A retainer is located below the bottom and secured around the lower portion of the mounting member. A fire suppressing powder within the container surrounds the explosive material housing. A fuse extends through the hole in the bottom and passage in the mounting member into the explosive material housing. Inflammation of the fuse ignites the explosive material, which creates sufficient pressure within the container to open the segment in the bottom along the score line and dispense the fire suppressing powder.

The explosive material preferably comprises a pellet having a receptacle into which the fuse extends. The pellet may be cylindrical, with the receptacle in the pellet extending along an axis of the pellet. The pellet may be formed of an explosive black powder.

The explosive material housing preferably has a cylindrical side wall. The side wall has a lower end that extends around and is secured to the head of the mounting member. A plurality of notches are spaced circumferentially around the head of the mounting member, each of the notches extending from an upper surface of the head to a sidewall of the head.

A washer of a porous, compliant material is positioned between the bottom and the head of the mounting member. In the preferred embodiment, the lower portion of the mounting member has a plurality of resilient collet legs that are biased radially outward from an axis of the mounting member against an edge of the hole in the bottom. An eyelet tube may be crimped to the fuse and extend upward into the explosive material housing and downward into the passage in the mounting member. An external flange on the eyelet tube rests on an upper surface of the head of the mounting member to retain the fuse within the explosive material housing.

A plate is mounted within the container a selected distance below the top and surrounded by the fire suppressing powder. At least a portion of the plate is movable a short distance toward and away from the top in response to the ignition of the explosive material so as to facilitate movement of the fire suppressing powder from the container.

DETAILED DESCRIPTION OF THE DISCLOSURE

Figure 1:
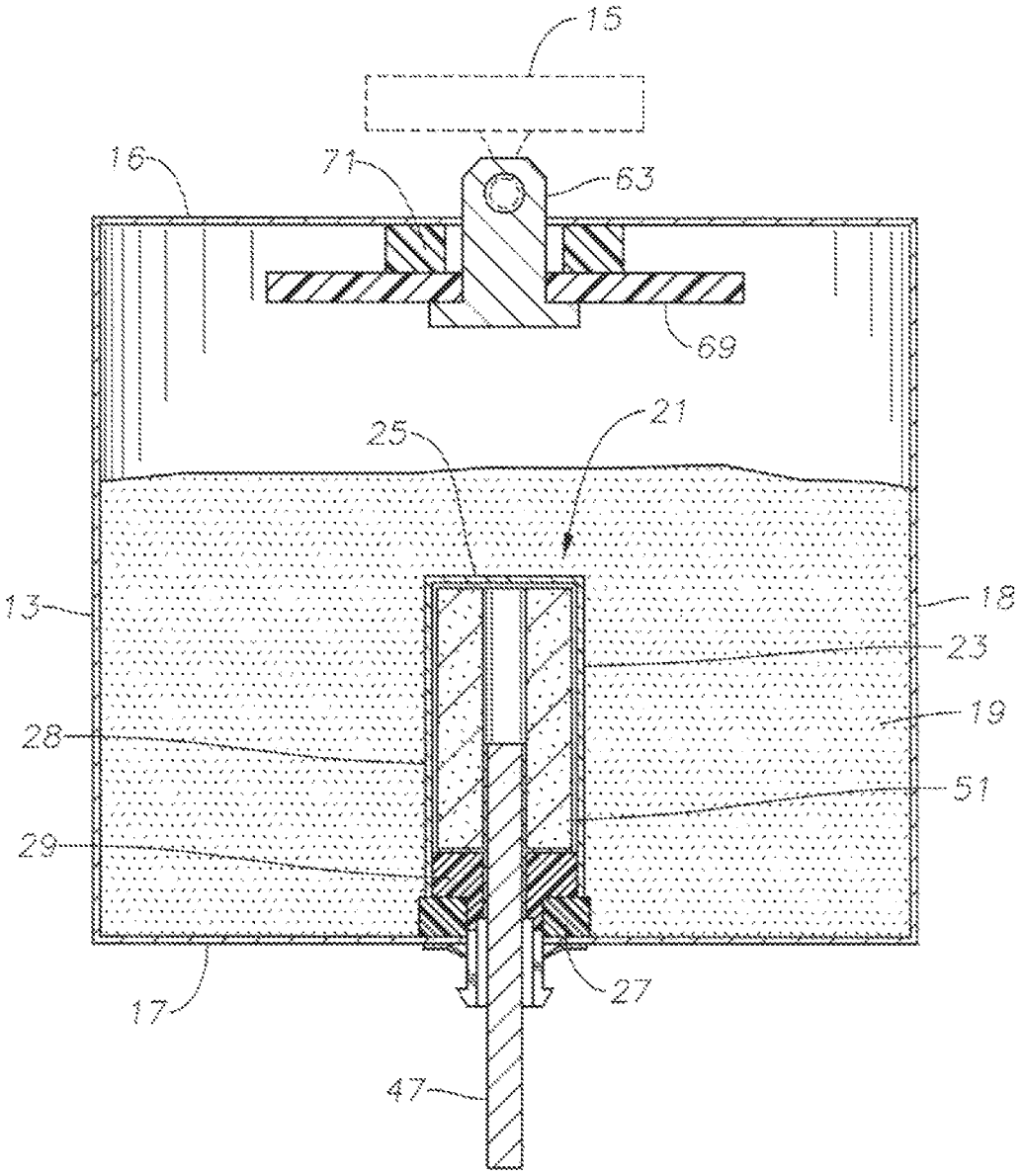
FIG. 1 is vertical sectional view of a fire suppressant device constructed in accordance with the disclosure.

Referring to FIG. 1, fire extinguisher 11 has a container 13 for securing to a place above or adjacent a possible source of a fire. For example, container 13 may be mounted by a magnet 15 to a hood above a cook stove. Container 13 is illustrated as being a cylindrical cup-shaped member with a closed top 16 and a bottom lid 17 attached to a lower edge of a cylindrical side wall 18. Other shapes are feasible. Container 13 holds a conventional fire extinguishing or suppressing powder 19 that will flow out bottom lid 17 when bottom lid 17 is opened.

Figure 2:
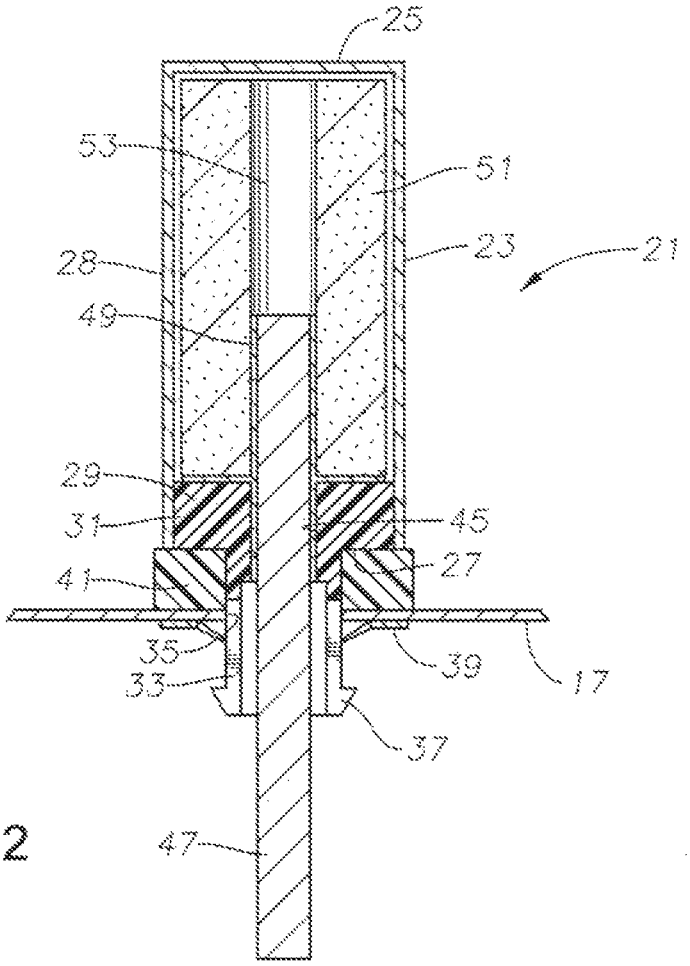
FIG. 2 is an enlarged vertical sectional view of an initiator of the fire suppressant device of FIG. 1.

An initiator 21 is mounted within container 13 for opening bottom lid 17 in response to sensing flames. Referring to FIG. 2, initiator 21 has a cylindrical explosive material housing 23, preferably formed of aluminum. Housing 23 has a closed top 25, an open bottom 27, and a cylindrical side wall 28.

Housing 23 secures to a mounting member 29, which is a plastic fastener having an enlarged head 31 in this example. The lower portion of the cylindrical side wall of housing 23 at bottom 27 is tightly secured to the cylindrical periphery of head 31, such as by a press-fit. In this embodiment, housing bottom 27 is flush with the lower side of mounting member head 31. Mounting member 29 has a lower portion comprising a plurality of legs 33 extending downward from head 31 and separated by vertical slots, defining a collet. Legs 33 extend through a hole 35 in bottom lid 17, and each optionally has a foot 37 protruding outward from a lower end. Legs 33 may deflect radially inward and are resilient. The circumscribed diameter of legs 33 is larger than hole 35 prior to insertion through hole 35. Legs 33 will deflect radially inward while passing through hole 35, then snap back outward once feet 37 pass through. The resiliency of legs 33 biases them radially outward against the edge of hole 35. Head 31 has a larger diameter than hole 35 and the circumscribed diameter of legs 33 prior to insertion into hole 35. A lock ring 39, which may be of metal or plastic, has a central aperture with frictional gripping tabs 40 that grip legs 33 above feet 37 and below bottom 17.

A washer 41 preferably locates on the upper side of bottom lid 17. Washer 41 has an upper side that abuts the downward-facing shoulder defined by mounting member head 31. The lower side of washer 41 abuts the upper surface of bottom lid 17. Mounting member legs 33 extend through an opening in washer 41. The outer diameter of washer 41 may be the same or larger than the outer diameter of housing 23. Washer 41 is preferably compliant and resilient and may be formed of a material such as felt.

Figure 3:
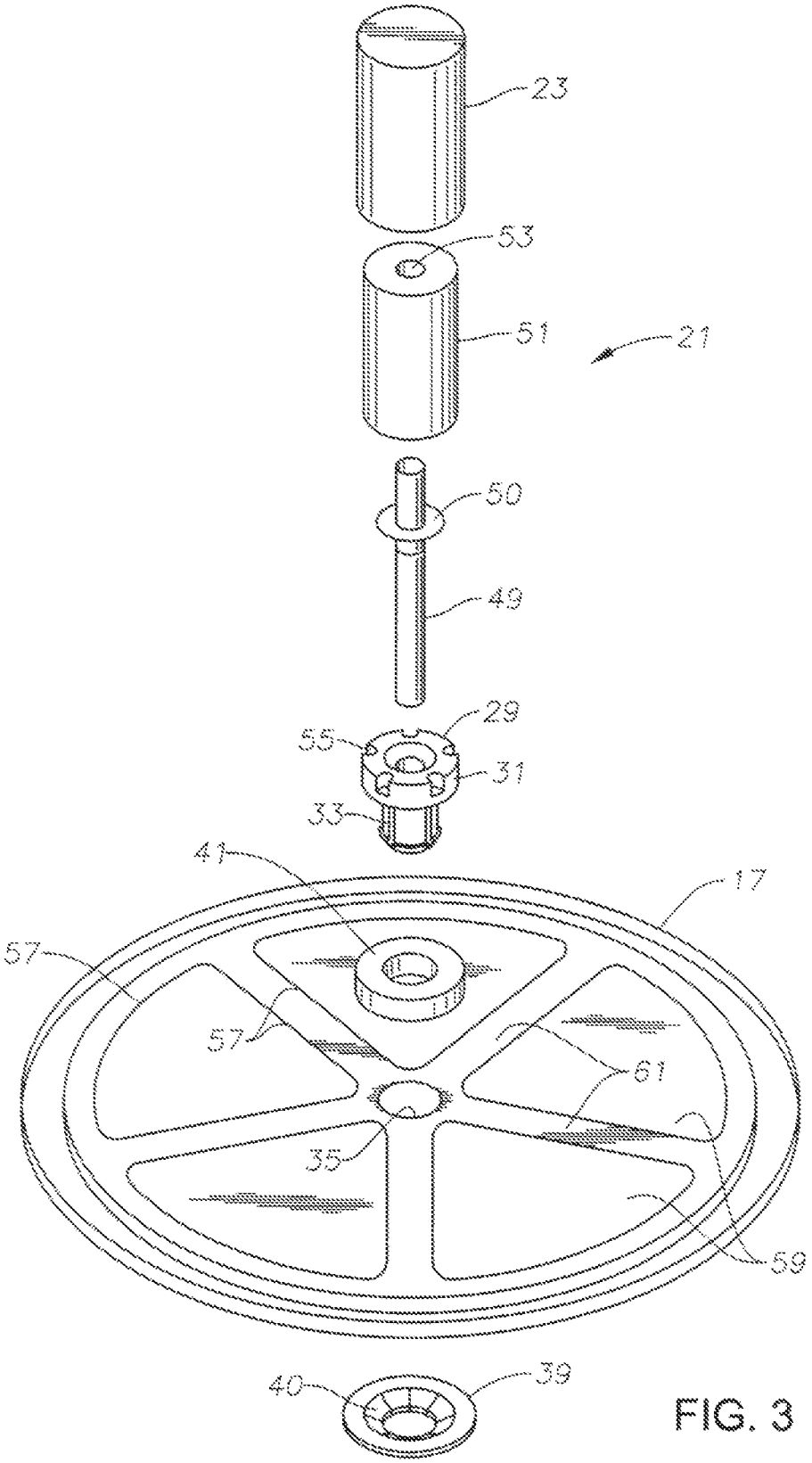
FIG. 3 is an exploded assembly view of the initiator of the fire suppressant device of FIG. 1.

A fuse 47 protrudes below mounting member legs 33. Fuse 47 is a strip of combustible material that will ignite when contacted by flames. Fuse 47 extends through mounting member hole 45 into initiator lousing 23. Fuse 47 may have an eyelet 49 surrounding it that extends tightly into mounting member hole 45 to retain fuse 47. Eyelet 49 is a cylindrical tube with an external flange, as shown in FIG. 3. Eyelet 49 is crimped onto the upper end of fuse 47.

Initiator housing 23 contains an explosive material, which in this example comprises a cylindrical black powder pellet 51. Pellet 51 has an axial passage or receptacle 53 into which fuse 47 and eyelet 49 extend. Eyelet external flange 50 is supported on the upper side of mounting member head 31.

Referring to FIG. 3, mounting member head 31 has notches 55 formed on its upper side adjacent the outer diameter of head 31. Notches 55 may be equally spaced apart around the periphery of head 31. Each notch 55 intersects the outer cylindrical surface of head 31 and the flat upper side of head 31. Notches 55 need not extend completely inward to mounting member passage 45.

FIG. 3 illustrates score lines 57 formed within bottom lid 17. Score lines 57 in this example are arranged in a pattern defining triangular-shaped segments 59 separated by radial spokes 61. The number of segments 59 and spokes 61 may vary. Score lines 57 form weak points that facilitate segments 59 shearing from spokes 61 when powder pellet 51 ignites.

Figure 4:
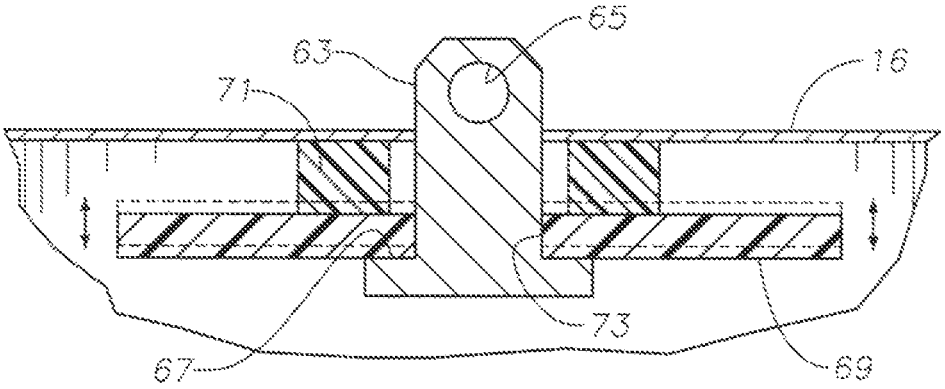
FIG. 4 is an enlarged vertical sectional view of a deflecting plate of the fire suppressant device of FIG. 1.

Referring to FIG. 4, a rod 63 extends through a hole in top 16. Rod 63 has a transverse hole 65 above top 16 for securing magnet 15 (FIG. 1) to container 13. Rod 63 has an upward-facing shoulder 67 located below top 16. A deflecting plate or disk 69 has a central hole that receives rod 63 such that plate 69 rests on shoulder 67. A washer 71 slides over rod 63 and is located between plate 69 and top 16. Washer 71 is of a compliant, flexible material, preferably permeable and porous, such as felt. Washer 71 fits snuggly between plate 69 and top 16, spacing plate 69 a distance below top 16 that is equal to the thickness of washer 71. The thickness of washer 71 may vary, but is preferably ⅛ to ⅜ inch. The thickness of washer 71 may be greater than the thickness of washer 41 (FIG. 2), which engages bottom 17.

Plate 69 is flat and in this example, parallel to top 16. Plate 69 may be circular and has an outer diameter less than an outer diameter of top 16. Preferably, the outer diameter of plate 69 is in a range from 50% to 75% the outer diameter of top 16. Plate 69 has a central opening 73 slightly larger in diameter than rod 63 above upward-facing shoulder 67. The outer diameter of plate 69 is also preferably greater than an outer diameter of washer 41. Plate 69 is preferably of an elastomeric material such as Nylon that is resilient when deflected a slight amount.

To assemble fire extinguisher 11, an assembler will place powder pellet 51 in housing 23 and insert fuse 47 into powder pellet passage 53. Mounting member 29 slides over eyelet 49, fuse 55 and into washer 41. This sub-assembly is placed on the upper side of bottom lid 17 with mounting member legs 33 and the lower portion of fuse 47 extending through bottom lid hole 35. From the other side, the assembler places lock ring 39 over mounting member legs 33, then snaps lock ring 39 past mounting member feet 37. Referring to FIG. 1, the operator fills container 13 with fire suppressant powder 19, then secures bottom lid 17 to the lower edge of container 13 in a conventional manner.

In operation, if flame reaches fuse 47, it will ignite powder pellet 51, creating an explosion that is directed radially outward through notches 55 (FIG. 3) into container 13. The explosion causes the side wall of initiator housing 23 to shear approximately at the upper side of mounting member 29. The high pressure due to the explosion causes score lines 57 to shear, releasing segments 59. Segments 59 fold downward from bottom 27. Suppressant powder 19 flows downward from container 13 through holes previously occupied by segments 59 onto the flames to extinguish the fire.

The dotted lines in FIG. 4 indicate axial deflection of plate 69 due to the ignition of explosive material pellet 51 (FIG. 2). The ignition of explosive material pellet 51 increases the pressure and creates a shock within container 11 that causes at least a portion of plate 69 to move closer to top 16, then back away from top 16, then back to a planar configuration. Some of the deflection may occur due to the periphery of plate 69 flexing upward and downward relative to the central portion of plate 69. The upper side of plate 69 becomes slightly concave momentarily, then convex momentarily before returning to a flat plane. In addition, the explosive shock applied to plate 69 may cause washer 71 to compress, allowing the entire plate 69 to move slightly upward on rod 63, then back downward as washer 71 decompresses. This axial movement of at least a portion of plate 69 breaks up any compactness in fire extinguishing powder 19 (FIG. 1), to assist in powder 19 flowing out of container 11.

While the disclosure has been shown in only one of its forms, it should be apparent to those skilled in the art that it is not so limited, but is susceptible to various changes without departing from the scope of the invention.

The invention claimed is:

1. An apparatus for suppressing a fire, comprising:

a container having a top and a bottom with a hole, the bottom having a score line defining a segment;

an explosive material housing within the container and containing an explosive material that comprises a solid pellet;

a mounting member having a head larger in cross-sectional dimension than the hole in the bottom and positioned within the container, the mounting member having a lower portion smaller in cross-sectional dimension than the head, depending downward from the head and extending through the hole in the bottom, the explosive material housing being secured to the head of the mounting member;

a retainer located below the bottom and secured around the lower portion of the mounting member to secure the mounting member to the bottom;

a fire suppressing powder within the container and surrounding the explosive material housing;

a plurality of notches spaced circumferentially around the head of the mounting member, each of the notches extending from an upper surface of the head to a sidewall of the head; and a fuse extending through the hole in the bottom and a passage in the mounting member into the explosive material housing, wherein lighting of the fuse by a flame ignites the explosive material, which creates sufficient pressure within the container to open the segment in the bottom along the score line and dispense the fire suppressing powder.

2. The apparatus according to claim 1, wherein an aperture is formed axially in the pellet to define a receptacle into which the fuse extends.

3. The apparatus according to claim 2, wherein the receptacle in the pellet extends through the entire length of the pellet.

4. The apparatus according to claim 2, wherein the pellet is formed of an explosive black powder.

5. The apparatus according to claim 1, wherein:

the housing has a cylindrical side wall; and the side wall has a lower end that extends around and is secured to the head of the mounting member.

6. The apparatus according to claim 1, further comprising a washer of a porous, compliant material positioned between the bottom and the head of the mounting member.

7. The apparatus according to claim 1, wherein the lower portion of the mounting member comprises a plurality of resilient collet legs that are biased radially outward from an axis of the mounting member against an edge of the hole in the bottom.

8. The apparatus according to claim 1, further comprising:

an eyelet tube into which the fuse extends, the eyelet tube being crimped to the fuse, extending upward into the explosive material housing and downward into the passage in the mounting member; and an external flange on the eyelet tube that rests on an upper surface of the head of the mounting member to retain the fuse within the explosive material housing.

9. The apparatus according to claim 1, further comprising a an lock ring having an opening formed axially therethrough through which an end of the mounting member is selectively inserted, and tabs that are formed by slits that project radially in the lock ring from an outer circumference of the opening, wherein when the end of the mounting member is inserted through the opening in the lock ring, the tabs are in interfering contact with the mounting member and couple the mounting member to the container.

10. An apparatus for suppressing a fire, comprising:

a container having a top and a bottom with a hole, the bottom having a score line defining a segment;

an explosive material housing within the container and containing an explosive material;

a mounting member having a head larger in cross-sectional dimension than the hole in the bottom and positioned within the container, the mounting member having a lower portion smaller in cross-sectional dimension than the head, depending downward from the head and extending through the hole in the bottom, the explosive material housing being secured to the head of the mounting member;

a retainer located below the bottom and secured around the lower portion of the mounting member to secure the mounting member to the bottom;

a fire suppressing powder within the container and surrounding the explosive material housing;

a fuse extending through the hole in the bottom and a passage in the mounting member into the explosive material housing, wherein lighting of the fuse by a flame ignites the explosive material, which creates sufficient pressure within the container to open the segment in the bottom along the score line and dispense the fire suppressing powder; and a plate mounted within the container a selected distance below the top, at least a portion of the plate being movable a short distance toward and away from the top in response to ignition of the explosive material, so as to facilitate movement of the fire suppressing powder from the container.

11. An apparatus for suppressing a fire, comprising:

a container having a top and a bottom with a hole, the bottom having a score line defining a segment;

an explosive material housing within the container and containing an explosive material;

a mounting member comprising, a cylindrical head set on the bottom of the container, a passage extending axially through the head and generally coaxial with the hole in the bottom of the container, collet legs depending axially from a side of the head facing the bottom of the container and that extend through the hole in the bottom of the container, and that each have a foot that projects radially outward, so that an outer periphery of each foot collectively define a curved path with a diameter greater than a diameter of the hole in the bottom of the container to form an interference fit with the bottom of the container to secure the mounting member to the container;

an annular eyelet tube into which the fuse extends, the eyelet tube being crimped to the fuse, extending upward into the explosive material housing and downward into the passage in the mounting member;

an external flange on the eyelet tube that rests on an upper surface of the head of the mounting member to retain the fuse within the explosive material housing; and a lock ring with an opening strategically sized for insertion therein of the collet legs, and having flexible tabs that extend radially outward from the opening and that axially deflect during insertion of the collet legs into the opening.

12. The apparatus according to claim 11, wherein the flange extends between the pellet and the cylindrical head.

* * * * *